US006062835A

United States Patent [19]

Acharya et al.

[11] Patent Number: 6,062,835

[45] Date of Patent: May 16, 2000

[54] GEROTOR MOTOR AND PARKING LOCK ASSEMBLY THEREFOR

[75] Inventors: Barun Acharya, Hopkins; Gary R. Kassen, Chanhassen; Scott E. Yakimow, Burnsville, all of Minn.

[73] Assignee: Eaton Corporation, Cleveland, Ohio

[21] Appl. No.: 08/957,487

[22] Filed: Oct. 24, 1997

Related U.S. Application Data

[63] Continuation-in-part of application No. 08/783,489, Jan. 14, 1997.

[51] Int. Cl.[7] ..... F01C 1/02

[52] U.S. Cl. ..... 418/61.3; 418/181

[58] Field of Search ..... 418/61.3, 181

[56] References Cited

U.S. PATENT DOCUMENTS

| | | | |
|---|---|---|---|
| 3,087,436 | 4/1963 | Dettlof et al. | 103/130 |
| 3,616,882 | 11/1971 | White | 192/3 R |
| 3,960,470 | 6/1976 | Kinder | 418/61.3 |
| 4,493,404 | 1/1985 | Wenker | 192/4 A |
| 4,597,476 | 7/1986 | Wenker | 192/3 R |
| 4,613,292 | 9/1986 | Bernstrom et al. | 418/61 B |
| 4,981,423 | 1/1991 | Bissonnette | 418/61.3 |
| 5,114,324 | 5/1992 | Spindeldreher | 418/61.3 |

FOREIGN PATENT DOCUMENTS

| | | |
|---|---|---|
| 3125087 | 1/1983 | Germany . |
| 84/01800 | 5/1984 | WIPO . |

*Primary Examiner*—Hoang Nguyen
*Attorney, Agent, or Firm*—L. J. Kasper

[57] ABSTRACT

A fluid pressure motor of the type including a gerotor gear set (15) including a star member (31) which orbits and rotates. The motor includes valving (41) which is disposed forwardly of the gerotor gear set, and an end cap assembly (21;111) disposed rearwardly of the gerotor gear set. The star member (31) defines a central opening (89;127) at the rearward end thereof, which may be defined by a separate insert member (125). Within the end cap assembly (21;111) is a lock piston (75;133) biased by a pair of Belleville washers (85,87;121) toward an engaged position (FIG. 1; FIG. 4) in which a lock portion (79) has its beveled portion (91;135) in engagement with the central opening (89;127) of the star (31), thus preventing any further orbital motion of the star, and serving as a parking lock. The lock piston (75;133) and end cap assembly (21;111) define a pressure chamber (99;119) which may be pressurized by an external signal (95) to move the lock piston to its disengaged position (FIG. 2) in which the beveled portion (91;135) is out of engagement with the central opening (89;127), and the star member (31) is permitted to orbit and rotate in the normal manner.

8 Claims, 4 Drawing Sheets

GEROTOR MOTOR AND PARKING LOCK ASSEMBLY THEREFOR

CROSS-REFERENCE TO RELATED APPLICATIONS

This application is a Continuation-In-Part (CIP) of co-pending U.S. application Ser. No. 783,489, Filed Jan. 14, 1997 in the name of Barun Acharya, Gary R. Kassen & Scott E. Yakimow for a "GEROTOR MOTOR AND PARKING LOCK ASSEMBLY THEREFOR".

BACKGROUND OF THE DISCLOSURE

The present invention relates to rotary fluid pressure devices, and more particularly, to such devices of the type including a fluid displacement mechanism which comprises a gerotor gear set.

Although the present invention may be included in a gerotor type device being utilized as a pump, it is especially adapted for use in a low-speed, high-torque gerotor motor, and will be described in connection therewith.

For years, many of the gerotor motors made and sold commercially, both by the assignee of the present invention as well as by others, have had the motor valving disposed "forwardly" of the gerotor gear set (i.e., toward the output shaft end of the motor), thus having nothing disposed "rearwardly" of the gerotor gear set except for an end cap. The present invention is especially adapted for use with gerotor motors of this type, and will be illustrated and described in connection therewith.

In many vehicle applications for low-speed, high-torque gerotor motors, it is desirable for the motor to have some sort of parking brake or parking lock, the term "lock" being preferred because it is intended that the parking lock be engaged only after the vehicle is stopped. In other words, such parking lock devices are not intended to be dynamic brakes, which would be engaged while the vehicle is moving, to bring the vehicle to a stop.

For many years, those skilled in the art have attempted to incorporate brake and lock devices into gerotor motors. Examples of such devices are illustrated and described in U.S. Pat. Nos. 3,616,882 and 4,981,423. In the device of U.S. Pat. No. 3,616,882, a braking element is disposed adjacent the forward end of the gerotor star, and is biased by fluid pressure into frictional engagement therewith. Such an arrangement involves a certain degree of unpredictability of performance, in view of variations in clearances, etc. Such an arrangement also requires a substantial redesign of the wear plate and forward bearing housing of the motor. In the device of U.S. Pat. No. 4,981,423, there is a multi-disc brake assembly which is of the "spring-applied, pressure-released" type. The arrangement of U.S. Pat. No. 4,981,423 also requires almost total redesign of the forward bearing housing, and also results in a much larger bearing housing. In addition, the disc pack is in splined engagement with the output shaft and, therefore, must be able to brake or hold the full output torque of the motor, thus necessitating that the discs, the spring, and the apply/release piston all be relatively larger.

A different approach to a parking lock was illustrated and described in U.S. Pat. No. 4,597,476, assigned to the assignee of the present invention and incorporated herein by reference. In the incorporated patent, the lock mechanism included a roller which could be moved from its normal, retracted position, which would permit normal orbital motion of the gerotor star, to a locked position, disposed at least partially within one of the volume chambers of the gerotor gear set, thus preventing normal orbital motion of the star. Although the device of the incorporated patent provides a generally satisfactory locking function, having such a member engage the star profile is generally considered undesirable, and the mechanism requires a substantial redesign of the gerotor ring, in which the lock actuator is located.

Also known to the assignee of the present invention, although perhaps not known publicly, is a parking lock arrangement in which a spring-applied, pressure-released piston is disposed in the end cap, and includes a cylindrical lock member which is received within a cylindrical bore in the end of the orbiting and rotating dogbone shaft. Although the arrangement described is generally functional, it has two significant disadvantages. The first is that, because the lock member has to fit within a bore defined by the dogbone shaft, it is necessarily fairly small in diameter, and has somewhat limited torque capacity. The second is that the cylindrical lock member within the cylindrical bore makes it nearly impossible to disengage the lock member under load.

SUMMARY OF THE INVENTION

Accordingly, it is an object of the present invention to provide a gerotor motor including a parking lock which overcomes the above-described disadvantages of the prior art.

It is a more specific object of the present invention to provide a parking lock for a gerotor motor which does not require any redesign of the gerotor gear set, or the portion of the motor disposed forwardly of the gerotor gear set.

It is another object of the present invention to provide such a parking lock device which is positioned such that it is not required to lock or hold the full output torque of the motor.

It is a further object of the present invention to provide such a parking lock device which does not require engagement by a lock member on the profile of the gerotor star.

The above and other objects of the invention are accomplished by the provision of a rotary fluid pressure device of the type including housing means defining a fluid inlet port and a fluid outlet port. The device includes a rotary fluid displacement mechanism including an internally toothed ring member and an externally toothed star member eccentrically disposed within the ring member for orbital movement relative thereto. Either the ring member or the star member has rotational movement, and the star member defines a central opening. The teeth of the ring member and the star member interengage to define expanding and contracting fluid volume chambers in response to the orbital and rotational movements. A valve means cooperates with the housing means to provide fluid communication from the inlet port to the expanding volume chambers, and from the contracting volume chambers to the outlet port. The device includes shaft means and means operable to transmit torque from the member having rotational movement to the shaft means. An end cap assembly is disposed rearwardly of, and immediately adjacent, the fluid displacement mechanism.

The device is characterized by the end cap assembly defining an internal chamber. A lock piston is disposed in the internal chamber, and includes a lock portion extending forwardly of the lock piston. The lock piston is movable between a first retracted position and a second position in which the lock portion engages the central opening of the star member to prevent the orbital movement of the star member.

In accordance with another aspect of the present invention, the device is characterized by the central opening of the star member being defined by an insert member received within the star member, and orbiting therewith, and the lock portion of the lock piston remaining generally within the central opening defined by the insert member as the lock piston moves between its first and second positions.

DESCRIPTION OF THE PREFERRED EMBODIMENT

Figure 1:
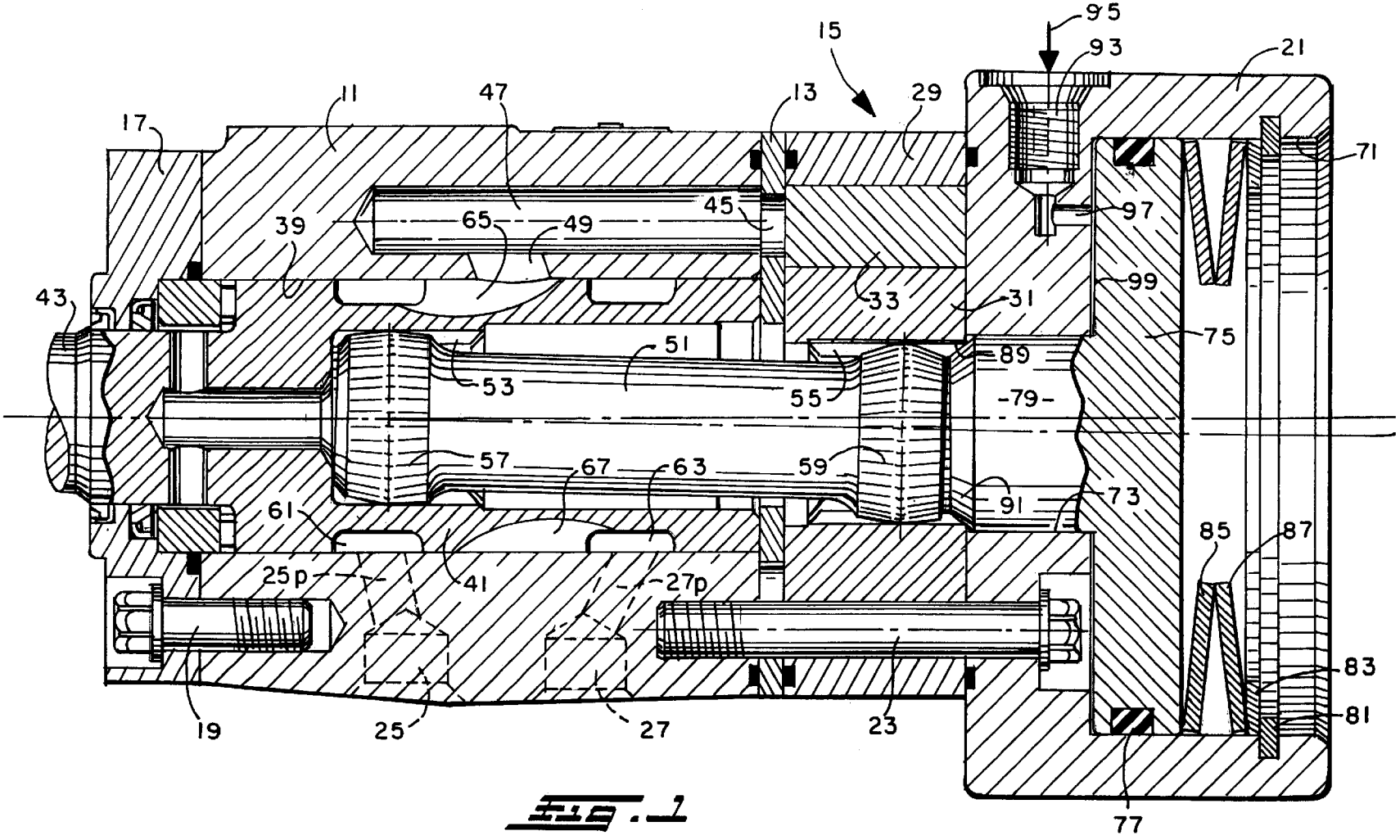
FIG. 1 is an axial cross-section of a gerotor motor including the parking lock mechanism of the present invention, in its engaged position.

Referring now to the drawings, which are not intended to limit the invention, FIG. 1 is an axial cross-section of a low-speed, high-torque gerotor motor of the type with which the parking lock mechanism of the present invention is especially advantageous. The gerotor motor shown in FIG. 1 may be of the general type illustrated and described in U.S. Pat. No. 4,592,704, assigned to the assignee of the present invention and incorporated herein by reference.

The gerotor motor of FIG. 1 comprises a valve housing section 11, a port plate 13, and a fluid energy-translating displacement mechanism, generally designated 15, which, in the subject embodiment, is a roller gerotor gear set. The motor includes a forward endcap 17, held in tight sealing engagement with the valve housing section 11 by means of a plurality of bolts 19, and a rearward endcap 21, held in tight sealing engagement with the gerotor gear set 15 by means of a plurality of bolts 23.

The valve housing section 11 includes a fluid inlet port 25, and a fluid outlet port 27, shown only schematically in FIG. 1. It is understood by those skilled in the art that the ports 25 and 27 may be reversed, thus reversing the direction of operation of the motor.

Figure 3:
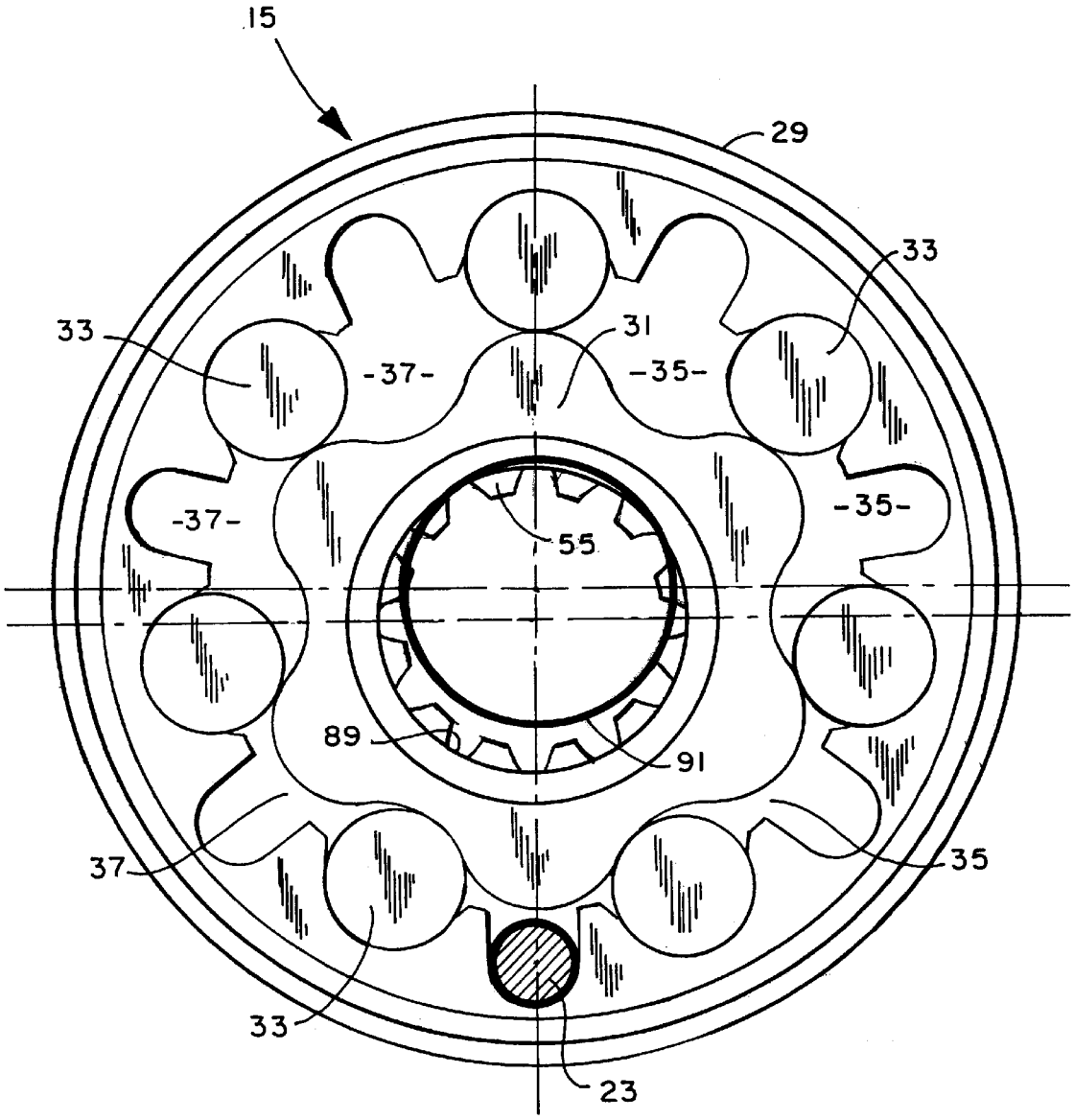
FIG. 3 is a transverse, plan view, taken on line 3—3 of FIG. 2, and on approximately the same scale.

Referring now to FIG. 3, in conjunction with FIG. 1, the gerotor gear set 15 includes an internally toothed ring member 29, through which the bolts 23 pass (only one of the bolts 23 being shown in FIG. 1), and an externally toothed star member 31. The internal teeth of the ring member 29 comprise a plurality of cylindrical rollers 33, as is now well known in the art. The teeth 33 of the ring 29 and the external teeth of the star 31 interengage to define a plurality of expanding volume chambers 35, and a plurality of contracting volume chambers 37, as is also well known in the art.

The valve housing section 11 defines a spool bore 39, and rotatably disposed therein is a spool valve 41. Formed integrally with the spool valve 41 is an output shaft 43, shown only fragmentarily in FIG. 1. In fluid communication with each of the volume chambers 35 and 37 is an opening 45 defined by the port plate 13, and in fluid communication with each of the openings 45 is an axial passage 47 formed in the valve housing section 11. Each of the axial passages 47 communicates with the spool bore 39 through an opening 49. The housing section 11 also defines fluid passages 25*p* and 27*p*, providing fluid communication between the spool bore 39 and the inlet port 25 and outlet port 27, respectively.

Disposed within the hollow, cylindrical spool valve 41 is a main drive shaft 51, commonly referred to as a "dog bone" shaft. The spool valve 41 defines a set of straight internal splines 53, and the star 31 defines a set of straight internal splines 55. The drive shaft 51 includes a set of external crowned splines 57 in engagement with the internal splines 53, and a set of external crowned splines 59 in engagement with the internal splines 55. Thus, the orbital and rotational movements of the star member 31 are transmitted, by means of the dog bone shaft 51, into purely rotational movement of the output shaft 43, as is well known in the art.

The spool valve 41 defines an annular groove 61 in continuous fluid communication with the inlet port 25, through the passage 25*p*. Similarly, the spool valve 41 defines an annular groove 63, which is in continuous fluid communication with the outlet port 27, through the passage 27*p*. The spool valve 41 further defines a plurality of axial slots 65 in communication with the annular groove 61, and a plurality of axial slots 67 in communication with the annular groove 63. The axial slots 65 and 67 are also frequently referred to as feed slots or timing slots. As is generally well known to those skilled in the art, the axial slots 65 provide fluid communication between the annular groove 61 and the openings 49, disposed on one side of the line of eccentricity of the gerotor set 15, while the axial slots 67 provide fluid communication between the annular groove 63 and the openings 49, which are on the other side of the line of eccentricity. The resulting commutating valve action between the axial slots 65 and 67 and the openings 49, as the spool valve 41 rotates, is well known in the art and will not be described further herein.

Those portions of the motor described up to this point are generally conventional. Referring still primarily to FIG. 1, the parking lock mechanism of the present invention will now be described. The rearward end cap 21 defines a relatively larger, rearward internal chamber 71, and a relatively smaller, forward internal chamber 73. In the subject embodiment, both of the chambers 71 and 73 are generally cylindrical. Disposed within the chamber 71 is a generally cylindrical lock piston 75, which includes an O-ring seal 77 disposed about its outer periphery and in sealing engagement with the internal surface of the chamber 71. The lock piston 75 includes a forward, cylindrical lock portion 79 which, preferably, is in a close-fit relationship with the internal chamber 73.

Disposed rearwardly of the piston 75, the internal chamber 71 includes an annular groove within which is seated a snap ring 81, which serves as a retainer for a wear ring 83. Disposed axially between the piston 75 and the wear ring 83 is a pair of Belleville washers 85 and 87, which bias the piston 75 in a forward direction (to the left in FIG. 1) toward the engaged position.

Referring again to FIG. 3, in conjunction with FIG. 1, the star member 31 defines, toward its rearward end, a central opening 89, which, in the subject embodiment, comprises a frusto-conical opening at the rearward end of the internal splines 55. The forward end of the lock portion 79 is provided with a beveled portion 91 and, preferably, the angle of the beveled portion 91 nearly matches the angle of the frusto-conical central opening 89, for reasons to be explained in greater detail subsequently.

The end cap 21 defines a pressure port 93 which is adapted to receive a pressure signal, shown schematically at 95, and communicate the signal through an axial passage 97 to a pressure chamber 99, which is defined between the forward surface of the piston 75 and an adjacent transverse surface 101 of the end cap 21. As may best be seen in FIG. 2, when an appropriate pressure signal 95 is communicated to the chamber 99, the resulting axial force on the lock piston 75 overcomes the biasing force of the Belleville washers 85 and 87, moving the washers 85 and 87 to the compressed position shown in FIG. 2, and moving the lock piston to its retracted position, in which the beveled portion 91 of the lock portion 79 is disengaged from the central opening 89 of the star 31. When the lock piston 75 is in the retracted or disengaged position shown in FIG. 2, the star member 31 is able to orbit and rotate in its normal manner. Thus, in the retracted (disengaged) position of the lock member 79, and as the star 31 orbits and rotates, the beveled portion 91 is not aligned with the opening 89 (see also FIG. 3), except at the one point in the orbital and rotational movement of the star 31 when there is alignment, i.e., the position shown in FIG. 1.

When the fluid pressure in the chamber 99 is vented or relieved, the biasing force of the Belleville washers moves the lock piston 75 forward and, typically, the forward transverse face of the beveled portion 91 engages the rearward face of the star 31, and is in sliding engagement therewith as the star orbits and rotates. After the star 31 has orbited a sufficient amount that the central opening 89 is coaxial with the forward internal chamber 73 (which occurs once per orbit of the star 31), the piston 75 moves forward to the engaged position shown in FIG. 1, with the beveled portion 91 engaging the central opening 89, thus locking the star 31 and preventing any further orbital and rotational movement thereof.

Figure 2:
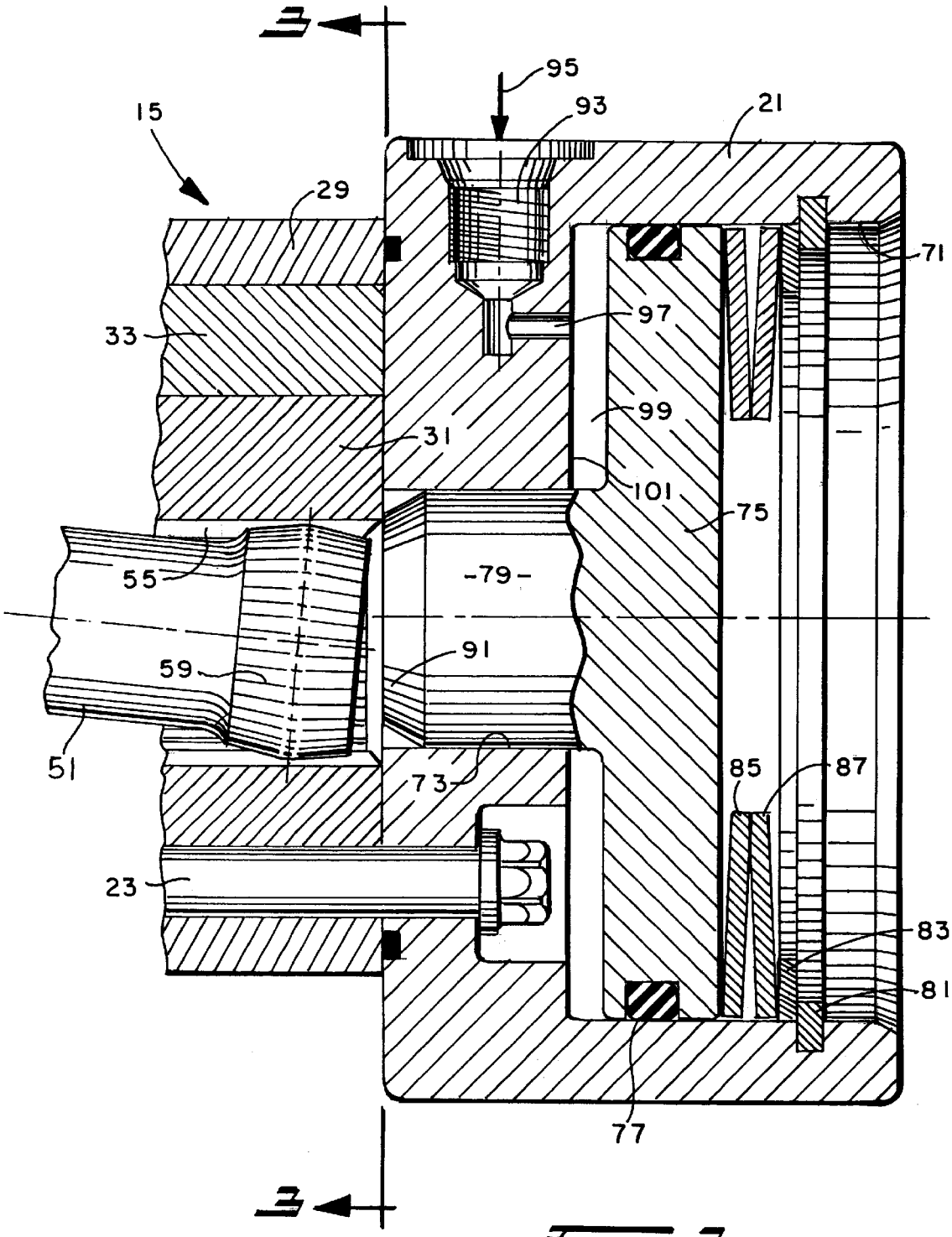
FIG. 2 is an enlarged, fragmentary axial cross-section, similar to FIG. 1, illustrating the parking lock mechanism of the present invention in its retracted, or disengaged, position.

The subject embodiment of the invention shows the use of the pressure port 93 to overcome the biasing force of the springs 85 and 87, and move the piston 75 to the disengaged position of FIG. 2. With this embodiment, the case drain region of the motor (i.e., the region surrounding the dog bone shaft 51), should remain at relatively low pressure, so that, when the pressure signal 95 is discontinued or blocked, pressure in the chamber 99 will be bled to the case drain region through the clearance between the chamber 73 and the outer surface of the lock portion 79. In this way, the piston 75 does not immediately shift to the engaged position. Instead, a predetermined period of time passes before the pressure in the chamber 99 is low enough to be overcome by the springs 85 and 87. The timing of the re-engagement of the lock portion 79 may be controlled solely by the clearance between the chamber 73 and the portion 79, or a notch or spiral groove may be provided (e.g., on the outer surface of the lock portion 79) to communicate the chamber 99 to the case drain region. As will be apparent to those skilled in the art, the flow area of the clearance, notch, or groove will determine the time of re-engagement.

Alternatively, the port 93 may be eliminated, and engagement of the lock portion 79 may be controlled by controlling the pressure in the case drain region. For example, a pressure of 150 psi. or more in the case drain would be sufficient to disengage the lock in the subject embodiment, in which case, the clearance, or notch, or groove between the chamber 73 and the lock portion 79 would be sized to delay re-engagement of the lock for the predetermined time period after the case drain pressure drops below 150 psi.

One of the advantages of the present invention is the accessibility of the lock piston 75 from outside the motor. With the vehicle hydraulic system not in operation, there would be no pressure signal 95 to move the piston 75 to the disengaged position, such that the lock member 79 would remain in the engaged position of FIG. 1 in the absence of hydraulic pressure at the port 93. In this condition, if it is desired to tow the vehicle, the accessibility of the lock piston 75 means that it may be provided with some sort of member or handle or other structure suitable for achieving manual disengagement of the lock piston 75, i.e., manually moving the lock piston to the retracted position shown in FIG. 2 while the vehicle is towed.

FIG. 4 Embodiment

Figure 4:
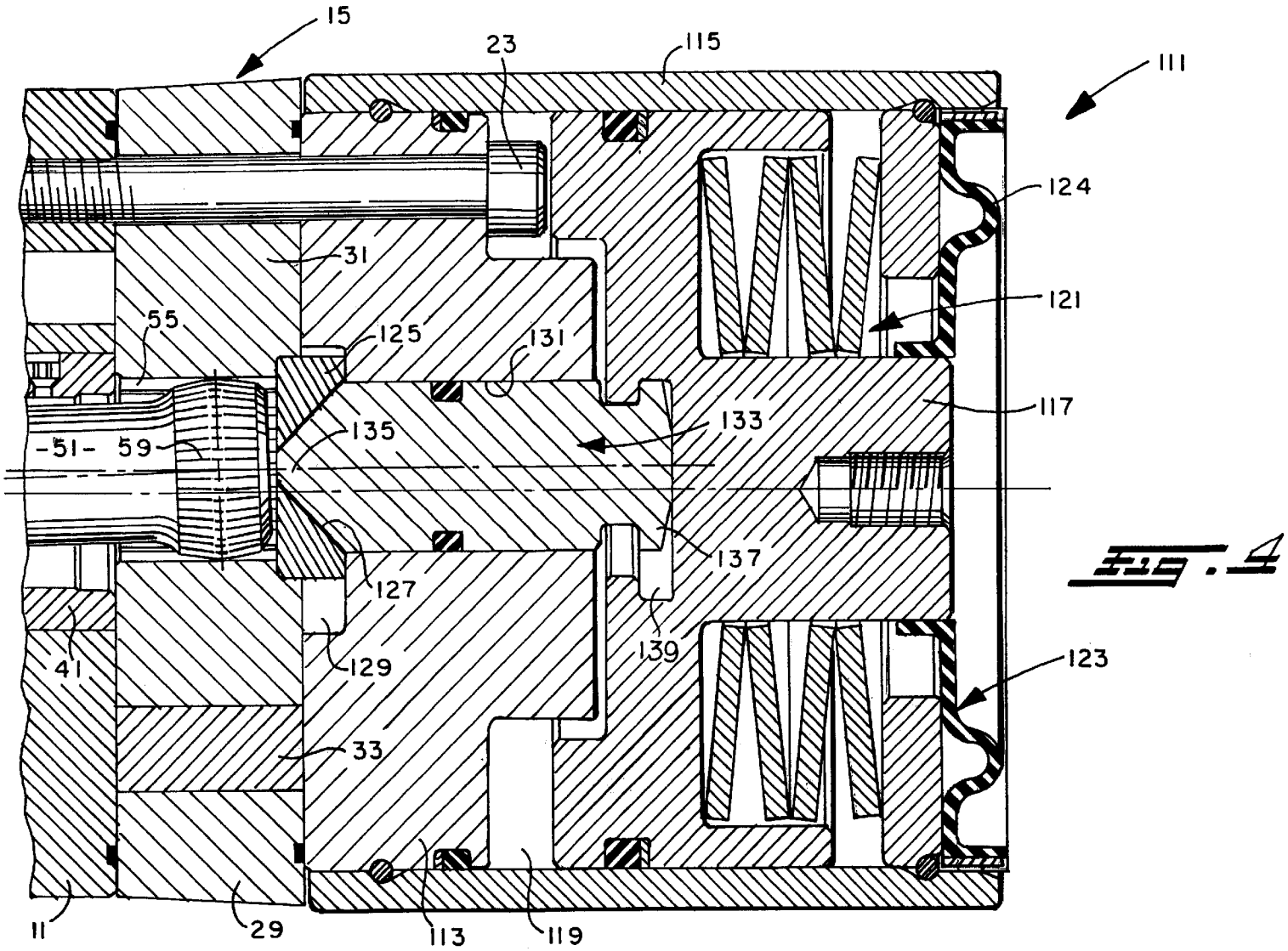
FIG. 4 is an enlarged, fragmentary axial cross-section similar to FIG. 2, illustrating an alternative embodiment of the present invention in its engaged position.

Referring now primarily to FIG. 4, an alternative embodiment of the invention will be described in which like elements bear like numerals, and new or substantially modified elements, compared to the embodiment of FIGS. 1 through 3, will bear reference numerals in excess of "110".

The embodiment of FIG. 4 includes a rearward endcap assembly, generally designated 111. The assembly 111 includes an endcap member 113 which is bolted to the remainder of the motor by the bolts 23, as in the primary embodiment. The member 113 is surrounded by a cylindrical housing 115, and axially slidable therein is a cylindrical piston 117. Both the endcap member 113 and the piston 117 are sealed on their outside diameters relative to the housing 115, to define therebetween a pressure chamber 119, with fluid pressure in the chamber 119 being operable to bias the piston 117 to the right in FIG. 4 in opposition to an assembly of Belleville washers, generally designated 121. The washers 121 are retained in the position shown by a retainer assembly 123, received within the right hand end of the housing 115, the assembly 123 including a rubber diaphragm 124 having an inner portion received on a reduced diameter portion of the piston 117, for movement therewith.

In the subject embodiment, the inside diameter of the star member 31, at its right end in FIG. 4, defines a counter bore and disposed therein is an insert member 125. The insert member 125 defines a generally frusto-conical central opening 127. The adjacent surface of the endcap member 113 defines a recess 129 which is larger in diameter than the insert member 125 by at least twice the eccentricity of the gerotor gear set 15, thus permitting the insert member 125 to orbit and rotate within the recess 129 as the star 31 orbits and rotates. The insert member 125 preferably comprises a hardened steel, and may be loosely received within the star counter bore, because it is constrained within the recess 129.

The endcap member 113 defines a generally central bore 131, the axis of which is offset from the axis of the motor by the eccentricity of the gerotor gear set 15 for reasons which will become apparent subsequently. Disposed within the bore 131 is a lock piston 133 including a forward lock portion 135 which is configured to mate with the central opening 127, on a surface-to-surface basis, when the piston 133 is in its engaged position shown in FIG. 4. The rearward end (right end in FIG. 4) of the piston 133 includes a reduced diameter portion defining a flange 137 which is inserted into, and trapped within an undercut 139 formed in the piston 117. As a result, the piston 133 is constrained to move axially with the piston 117, in either direction.

When the fluid pressure in the chamber 119 is relatively low, the assembly of washers 121 biases the pistons 117 and 133 to the engaged position shown in FIG. 4, with the lock portion 135 engaging the opening 127 and preventing orbital and rotational movement of the star 31, in the same general manner as described previously. It should be noted that references hereinafter, and in the appended claims, to the lock piston engaging the "central opening" of the star member 31 will be understood to mean and include either engaging the star member directly, as in the embodiment of FIGS. 1 through 3, or engaging a separate insert member, as in the FIG. 4 embodiment.

To disengage the lock, relatively high pressure fluid is introduced into the chamber 119, as was described in connection with the previous embodiment, the pressure being sufficient to overcome the biasing force of the washers 121, and move the pistons 117 and 133 to the right in FIG. 4, to the disengaged position. In the disengaged position of the piston 133, the lock portion 135 is still generally "within" the central opening 127, but is displaced just far enough to the right to permit full orbital and rotational movement of the star 31 and insert member 125, without any engagement of the lock portion 135 and the central opening 127 occurring. Thus, it may be seen that one advantage of the FIG. 4 embodiment is eliminating the engagement of the lock piston with the adjacent surface of the gerotor star, as the star orbits and rotates, and the lock piston then dropping into an opening in the star which, in some applications, could result in damage to the star and/or the lock piston.

It should be understood by those skilled in the art that, although the subject embodiment includes spool valving, the invention is not so limited, and the present invention may be utilized with gerotor motors having various types of disc valving, as long as the disc valving is disposed either forwardly of the gerotor gear set 15, or disposed rearwardly of the gerotor set, but with the valving action occurring far enough radially outward that the valving does not interfere with the lock member 79.

Thus, it may be seen that the present invention provides a parking lock which does not rely upon frictional engagement of members such as clutch discs, and is not located such that the parking lock is required to hold the full output torque of the motor. In the subject embodiment, in which the gerotor is a 6/7 gerotor, the torque required to prevent orbital and rotational motion of the star 31 is only one-sixth the torque required to prevent rotational motion of the output shaft 43. The reason for this is well understood to those skilled in the art of gerotor gear sets.

Furthermore, the present invention provides a parking lock which does not engage the profile of the star 31, thus eliminating potential damage to the profile, and does not require any substantial redesign of any portion of the motor disposed forwardly of the end cap 21. In other words, the parking lock of the present invention could be an optional feature for a standard motor in which the only change would be to replace the conventional end cap with the end cap 21 shown herein.

Finally, the parking lock of the present invention provides a lock member which is large enough in diameter, relative to the other parts of the motor, that it can readily have sufficient torque and load holding capability. Also, the frusto-conical configuration of the opening 89 and the mating bevel 91 is such that the lock portion 79 can be disengaged "under load", i.e., even after pressurized fluid is communicated to the expanding volume chambers 35, or in the case where an external load on the output shaft 43 is driving the star 31.

It is believed to be well within the ability of those skilled in the art to select the Belleville washers 85 and 87, the dimensions of the lock piston 75, the pressure for the signal 95, etc. to achieve the desired load holding capability, relative to the rated torque of the motor, while still being able to disengage the lock piston 75 under load.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A rotary fluid pressure device of the type including housing means defining a fluid inlet port and a fluid outlet port; a rotary fluid displacement mechanism including an internally-toothed ring member and an externally-toothed star member eccentrically disposed within said ring member for orbital movement therein, one of said ring member and said star member having rotational movement, and said star member defining a central opening; the teeth of said ring member and said star member interengaging to define expanding and contracting fluid volume chambers in response to said orbital and rotational movements; valve means cooperating with said housing means to provide fluid communication from said inlet port to said expanding volume chambers, and from said contracting volume chambers to said outlet port; shaft means and means operable to transmit torque from said member having said rotational movement to said shaft means; and an endcap assembly disposed rearwardly of, and immediately adjacent, said fluid displacement mechanism; characterized by:

(a) said endcap assembly defining an internal chamber;

(b) a lock piston disposed in said internal chamber, and including a lock portion extending forwardly of said lock piston;

(c) said lock piston being moveable between a first, retracted position, and a second position in which said lock portion extends within said central opening of said star member to prevent said orbital movement of said star member.

2. A rotary fluid pressure device as claimed in claim 1, characterized by said central opening of said star member being generally frusto-conical, and said lock portion including a beveled portion.

3. A rotary fluid pressure device as claimed in claim 1, characterized by said endcap assembly defining a cylindrical opening receiving and supporting said lock portion for axial movement therein between said first and second positions, said cylindrical opening being in substantial alignment with said central opening of said star member at one point in said orbital movement of said star member.

4. A rotary fluid pressure device as claimed in claim 1, characterized by spring means disposed in said internal chamber and operable to bias said lock piston forwardly, toward said second position in which said lock portion engages said central opening of said star member.

5. A rotary fluid pressure device as claimed in claim 4, characterized by said lock piston cooperating to define a fluid pressure chamber operable, in the presence of fluid pressure therein, to bias said lock piston rearwardly, toward said first retracted position.

6. A rotary fluid pressure device as claimed in claim 5, characterized by said endcap assembly defining a fluid port in fluid communication with said fluid pressure chamber, and adapted to be in fluid communication with a source of a pressure signal.

7. A rotary fluid pressure device as claimed in claim 5, characterized by said housing means, said valve means, and said fluid displacement mechanism cooperating to define a case drain region in fluid communication with a case drain, said fluid pressure chamber being in restricted fluid communication with said case drain region.

8. A rotary fluid pressure device as claimed in claim 1, characterized by said central opening of said star member being defined by an insert member received within said star member, and orbiting therewith, and said lock portion of said lock piston remaining generally within said central opening defined by said insert member as said lock piston moves between said first and second positions.

* * * * *